US008210194B2

(12) United States Patent
Rehkemper

(10) Patent No.: US 8,210,194 B2
(45) Date of Patent: Jul. 3, 2012

(54) TENT WITH SPRINKLER MECHANISM

(75) Inventor: Steven Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 95 days.

(21) Appl. No.: 12/781,286

(22) Filed: May 17, 2010

(65) Prior Publication Data

US 2010/0288320 A1 Nov. 18, 2010

Related U.S. Application Data

(60) Provisional application No. 61/178,763, filed on May 15, 2009.

(51) Int. Cl.

| | |
|---|---|
| ***E04H 15/36*** | (2006.01) |
| ***E04H 15/60*** | (2006.01) |
| ***E04H 15/02*** | (2006.01) |
| ***A63H 23/10*** | (2006.01) |

(52) U.S. Cl. ..... 135/96; 135/124; 135/114; 472/128; 446/153

(58) Field of Classification Search ..... 135/96, 135/99, 124, 156, 120.1, 114; 47/21.1; 446/153, 446/475; 472/128; 239/279, 289
See application file for complete search history.

(56) References Cited

U.S. PATENT DOCUMENTS

| | | | | |
|---|---|---|---|---|
| 2,727,366 | A * | 12/1955 | Hagen | 62/304 |
| 5,480,336 | A * | 1/1996 | Blanchard | 446/89 |
| 5,741,189 | A * | 4/1998 | Briggs | 472/128 |
| 5,820,472 | A * | 10/1998 | Briggs | 472/128 |
| 6,050,872 | A * | 4/2000 | Cahill et al. | 446/89 |
| 7,946,307 | B2 * | 5/2011 | Zheng | 135/96 |
| 2004/0050411 | A1 * | 3/2004 | Lawrence | 135/128 |
| 2004/0144858 | A1 * | 7/2004 | Sigler, Jr. | 239/289 |

* cited by examiner

*Primary Examiner* — David Dunn
*Assistant Examiner* — Danielle Jackson
(74) *Attorney, Agent, or Firm* — Adam K. Sacharoff

(57) ABSTRACT

A tent structure, water transfer system and sprinkler mechanism are provided. The water transfer system utilizes components of the tent structure to transfer water from a garden hose to the sprinkler mechanism positioned at the top of the tent structure to spray water above the tent structure.

5 Claims, 9 Drawing Sheets

10
30
26
40
25
40
30
30
26
26
26
33
33
30
26
26
46
22
35
20
31
32

TENT WITH SPRINKLER MECHANISM

The present invention claims priority to U.S. Provisional Application 61/178,763.

FIELD OF THE INVENTION

1. Field of the Invention

The present invention relates to a tent structure with a sprinkler mechanism positioned on the top of the tent to spray water into the air when a water transfer system is connected to a garden hose.

2. Background of the Invention

Tents and sprinklers are well known in the art. Presently, tents are used for camping and protection from the elements while sprinklers are used for watering lawns and occasional children's play. The present invention seeks to improve on the prior art by providing a structure, water transfer system and sprinkler to create an water enhanced and enjoyable play experience.

SUMMARY OF THE INVENTION

In accordance with the present invention, there is provided in one embodiment, an outdoor water tent device. The water tent device includes a tent structure defined to include a plurality of supports. The plurality supports secure an outer membrane thereto to define an enclosed area under the outer membrane and within the plurality of supports. A sprinkler mechanism positioned at the top of the tent structure. The sprinkler mechanism has a means for spraying liquid upwardly on top of a side of the outer membrane external to the enclosed area, whereby liquid sprayed from the sprinkler mechanism is directed upwardly such that the liquid tends to rain down on the top of the outer membrane maintaining the enclosed area substantially dry. Lastly, the water tent device would include a means for coupling the sprinkler mechanism to a pressurized source of liquid.

In other aspects of this embodiment, the means for coupling the sprinkler mechanism to a pressurized source of liquid may include, an inner channel running through one of the plurality of supports. The inner channel would have an upper end connected to an intake opening on the sprinkler mechanism, and would have a lower end and a base hose connector to securely attach the pressurized source of liquid to the lower end of the inner channel defined by one of the plurality of supports. The sprinkler mechanism may further include an upper tube, a spray aperture, a receiving port sized to receive an upper portion of the support such that the upper tube is in fluid communication with the inner channel at one end and in fluid communication with the spray aperture at the other end.

In yet other aspects, the outdoor water tent device could have the plurality of supports being inflatable segments and an upper portion of each of the inflatable segments fixed to the sprinkler mechanism positioned at the top of the structure. In this aspect, the base portion of each of the plurality of supports would be fixed to an inflatable base segment and the outer membrane would be joined to the inflatable segments and the inflatable base segment, such that the outer membrane prevents an enclosed area within the tent structure from receiving water.

Furthermore, the sprinkler mechanism may be motorized such that the water can spray would in a pattern. Alternatively, the tent device would further include a shower head with a triggering cord positioned within the tent structure. The triggering cord can be used to divert the water flow from the sprinkler mechanism to the shower head. This could be accomplished by a two directional valve positioned in the flow of water to divert water to the shower head. Pulling the triggering cord diverts the water flow to an outlet port on the two directional valve in fluid communication with the shower head, such that water is disbursed through the shower head and into the enclosed area.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1A:
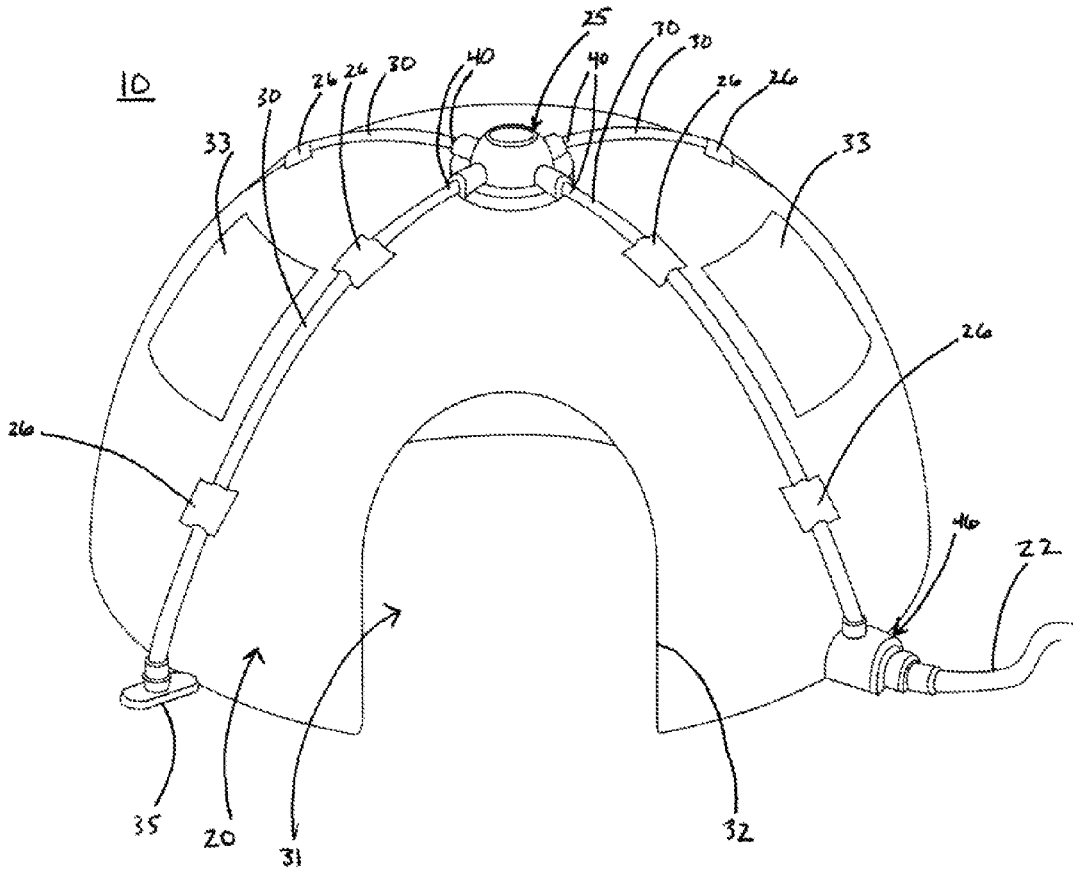
FIG. 1*a* is a front perspective view of a tent structure in accordance with an embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention, the claims or the embodiments illustrated.

Figure 1B:
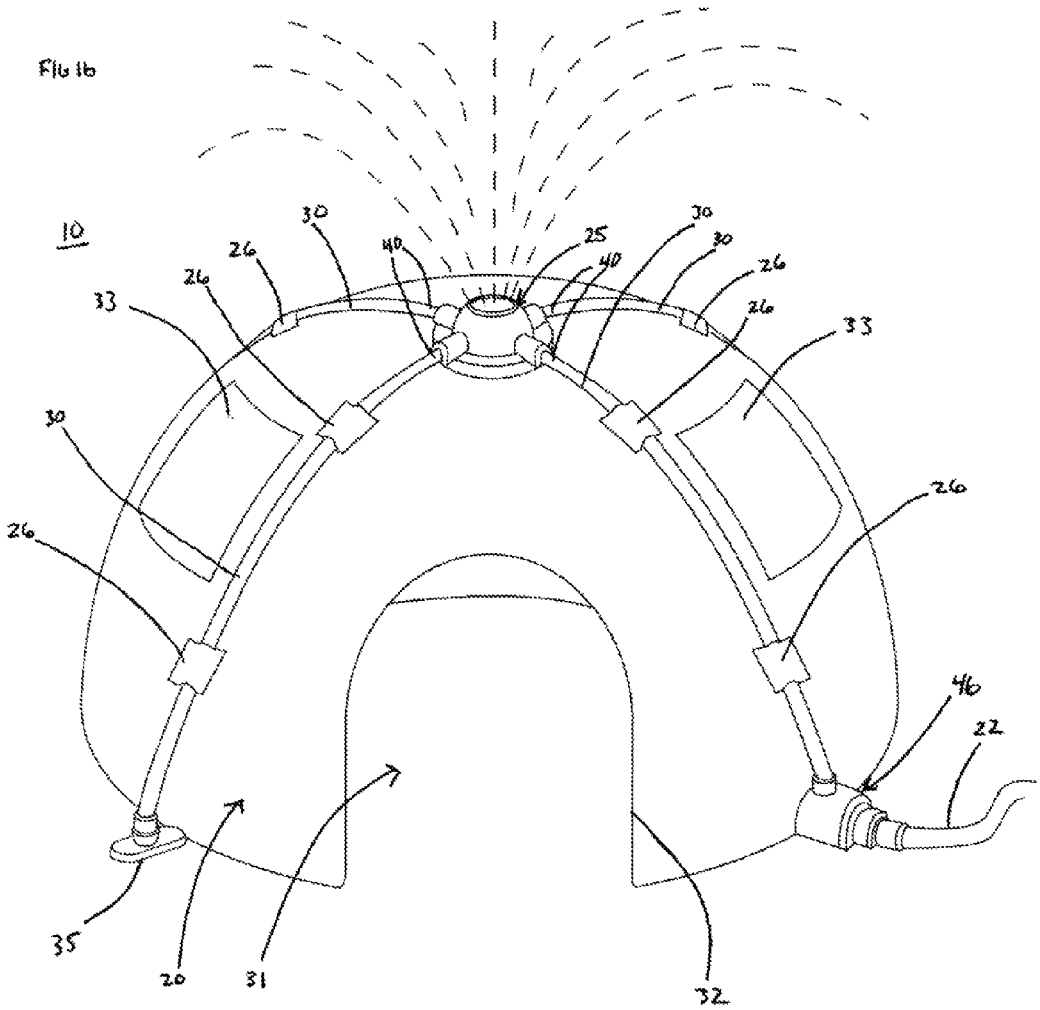
FIG. 1*b* is a front perspective view of a tent structure where a sprinkler mechanism is spraying water above the tent structure in accordance with an embodiment of the present invention.
Figure 2:
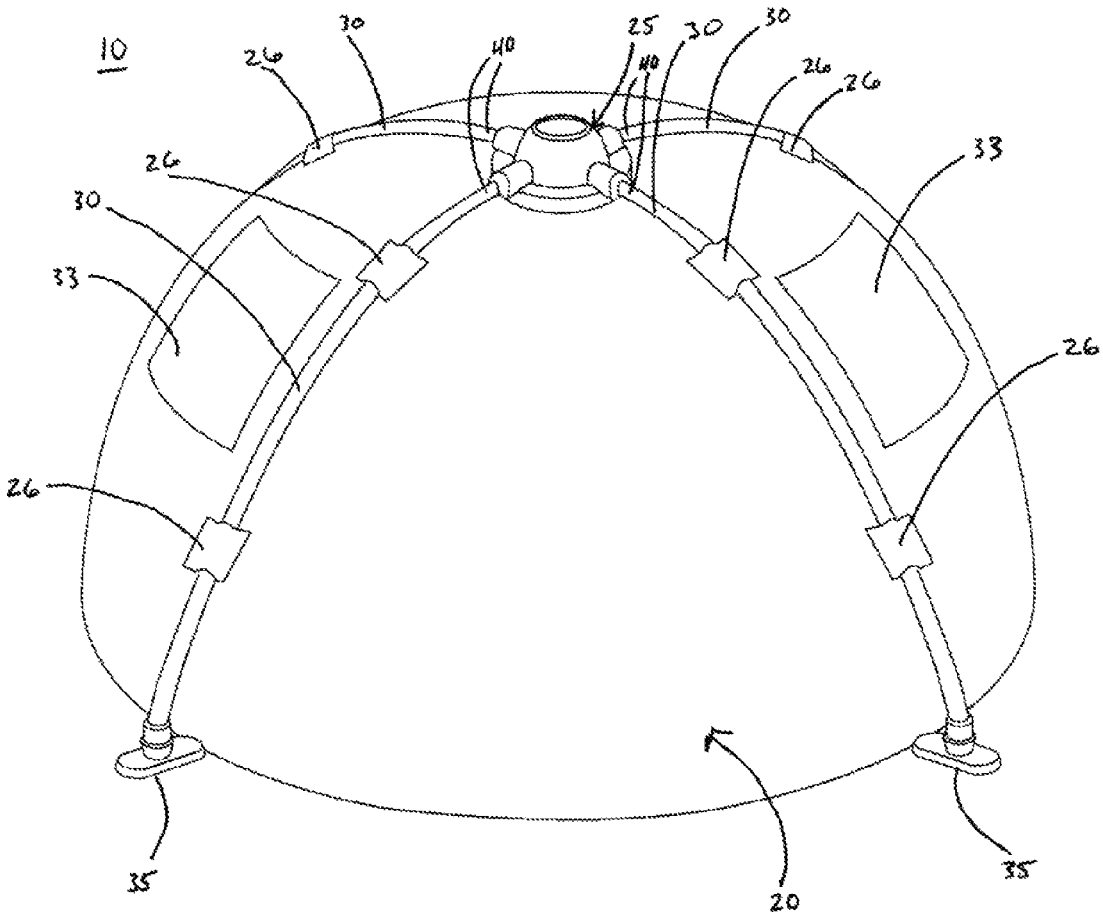
FIG. 2 is a rear perspective view of FIG. 1.

Referring now to FIGS. 1*a* through 2, in accordance to an embodiment of the present invention, there is illustrated a tent structure 10 that includes a frame, an outer membrane 20 and a water transfer system. Varying materials may be used for the outer membrane 20 and the frame of the tent. Water supplied from a pressurized liquid source, such as a garden hose 22 travels through the water transfer system, including a sprinkler mechanism 25, and is sprayed above the tent structure 10. The outer membrane 20 further includes a plurality of flaps 26 for the supports 30 to slide through during assembly, such that the frame further defines the shape of the tent structure 10 to form an enclosed area 31. The outer membrane 20 may include a doorway(s) 32 and window(s) 33 as desired. The windows(s) 33 may be covered with a transparent material or left open.

Figure 3:
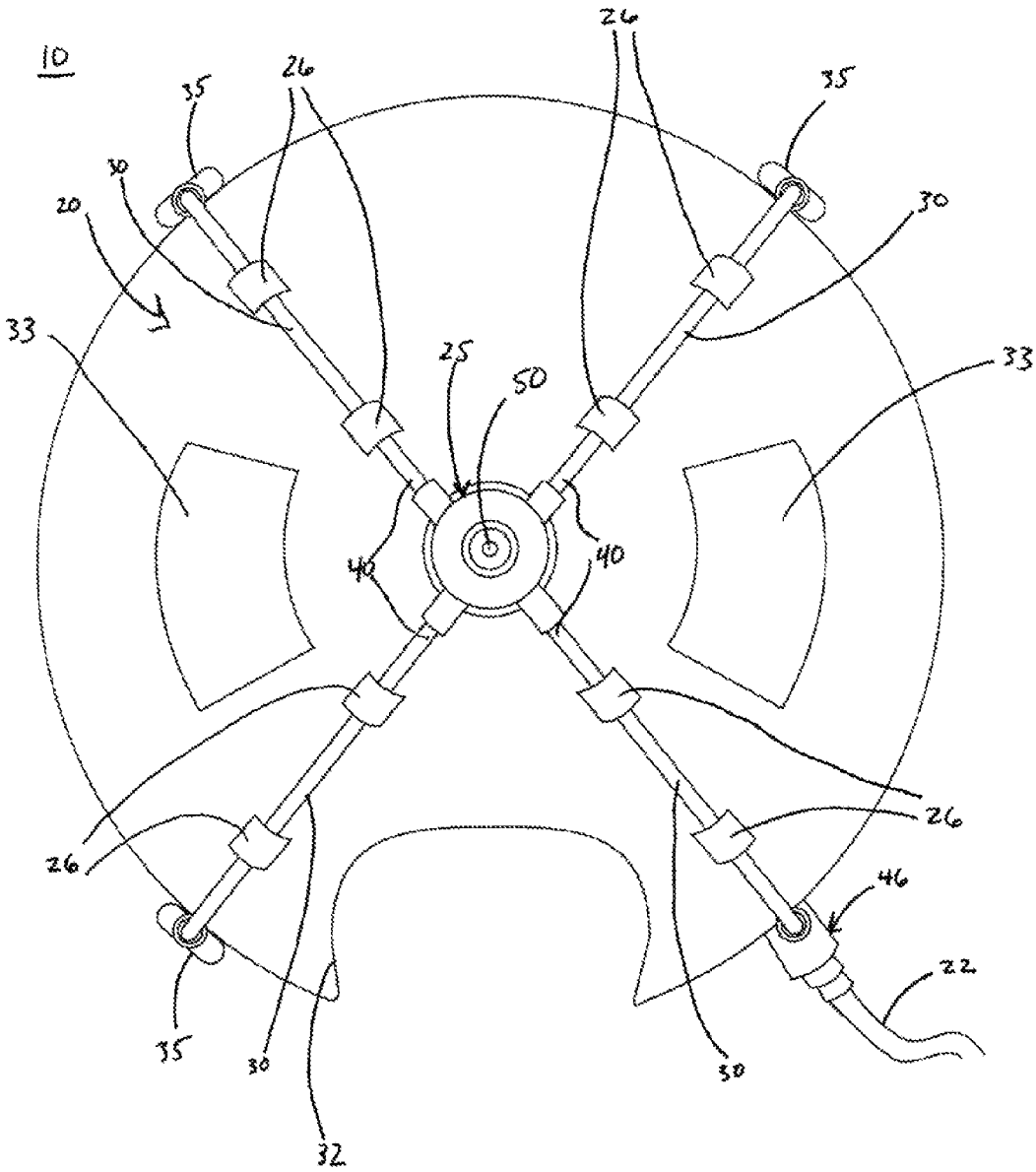
FIG. 3 is a top view of FIG. 1.
Figure 4:
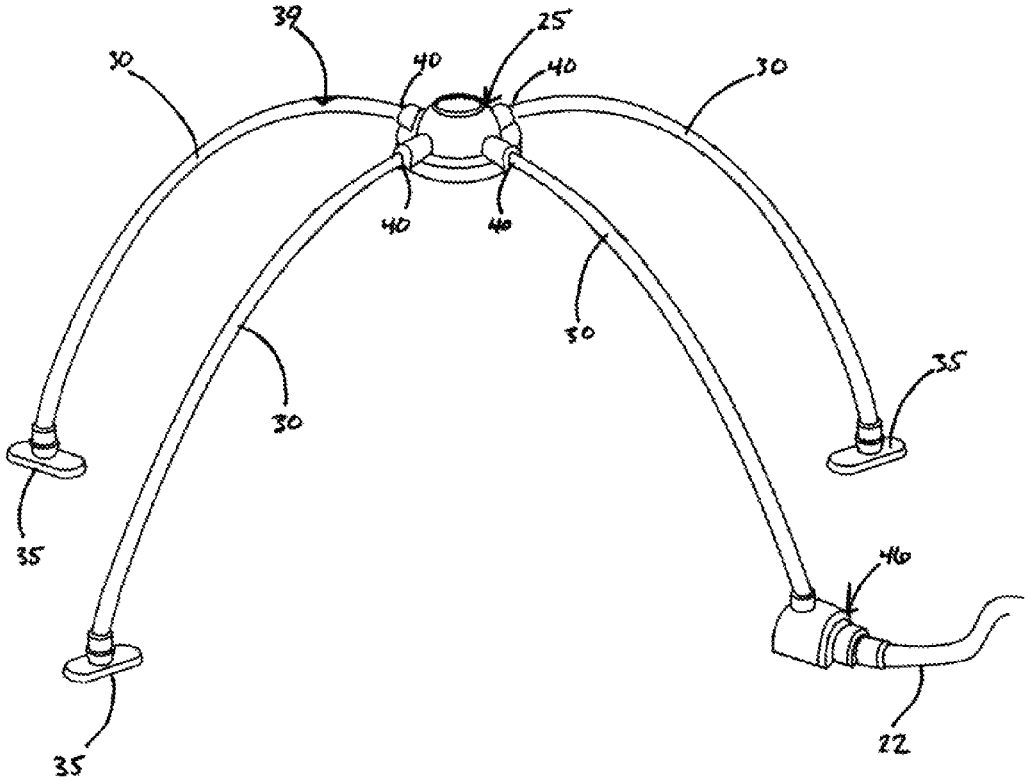
FIG. 4 front perspective view of a frame for a tent structure in accordance with an embodiment of the present invention.

Now additionally referring to FIGS. 3 and 4, the frame includes a plurality of supports 30. Each support has a base portion 35 positioned on the ground and an upper portion 40 which removably connects to the sprinkler mechanism 25, which has a plurality of apertures 45 sized to receive the upper portions 40 of the supports 30. A base hose connector 46 is removably connected to at least one of the supports 30. The sprinkler mechanism 25 also includes a spray aperture(s) 50 as shown in FIG. 3 through which water is disbursed or sprayed above the tent structure 10. Varying the size and/or shape of the spray aperture 50 will create different spray patterns.

Figure 5A:
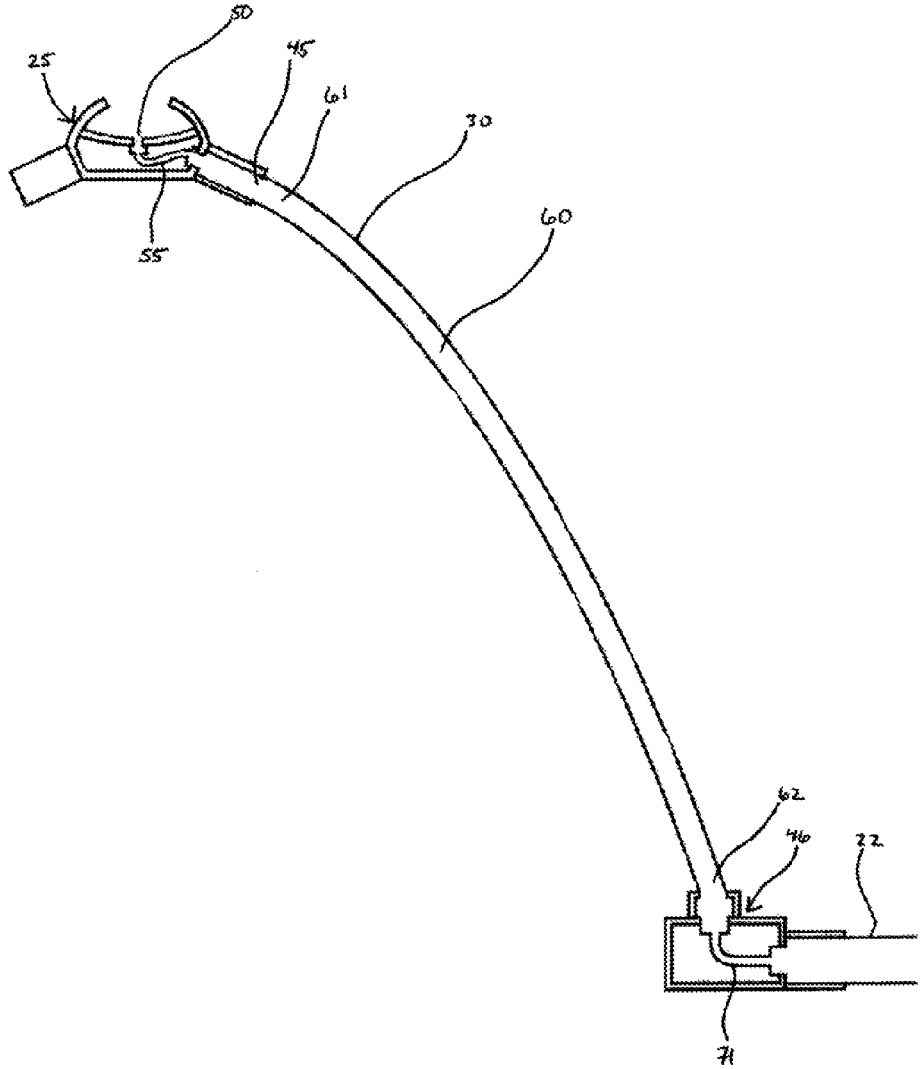
FIG. 5*a* is a side cutaway view of a water transfer system for a tent structure showing the path of water travel in accordance with an embodiment of the present invention.

FIG. 5*a* further shows the path of water travel within the water transfer system. The spray aperture 50 is in fluid connection with a tube 55 connected to at least one of the plurality of apertures 45 which is further removeably connected to one of the supports 30 with an internal channel 60 including an upper portion 61 and a lower portion 62, the internal channel 60 extending the length of the support 30 to the base hose connector 46. The base hose connector 46 removeably attaches to the garden hose 22, such that water may travel from the garden hose 22, through the base hose connector 46 via a tube 71, up through the internal channel 60 and sprinkler mechanism 25 via the tube 55 to spray out of the spray aperture 50 as shown in FIG. 1*b*. The height of the sprayed water may be adjusted in accordance with the water pressure level from the garden hose 22 and the size/shape of the spray aperture 50 as described above. Pressure regulating valves may be included in the water transfer system to further adjust the water pressure and consequently, the extent of the water spray.

Figure 5B:
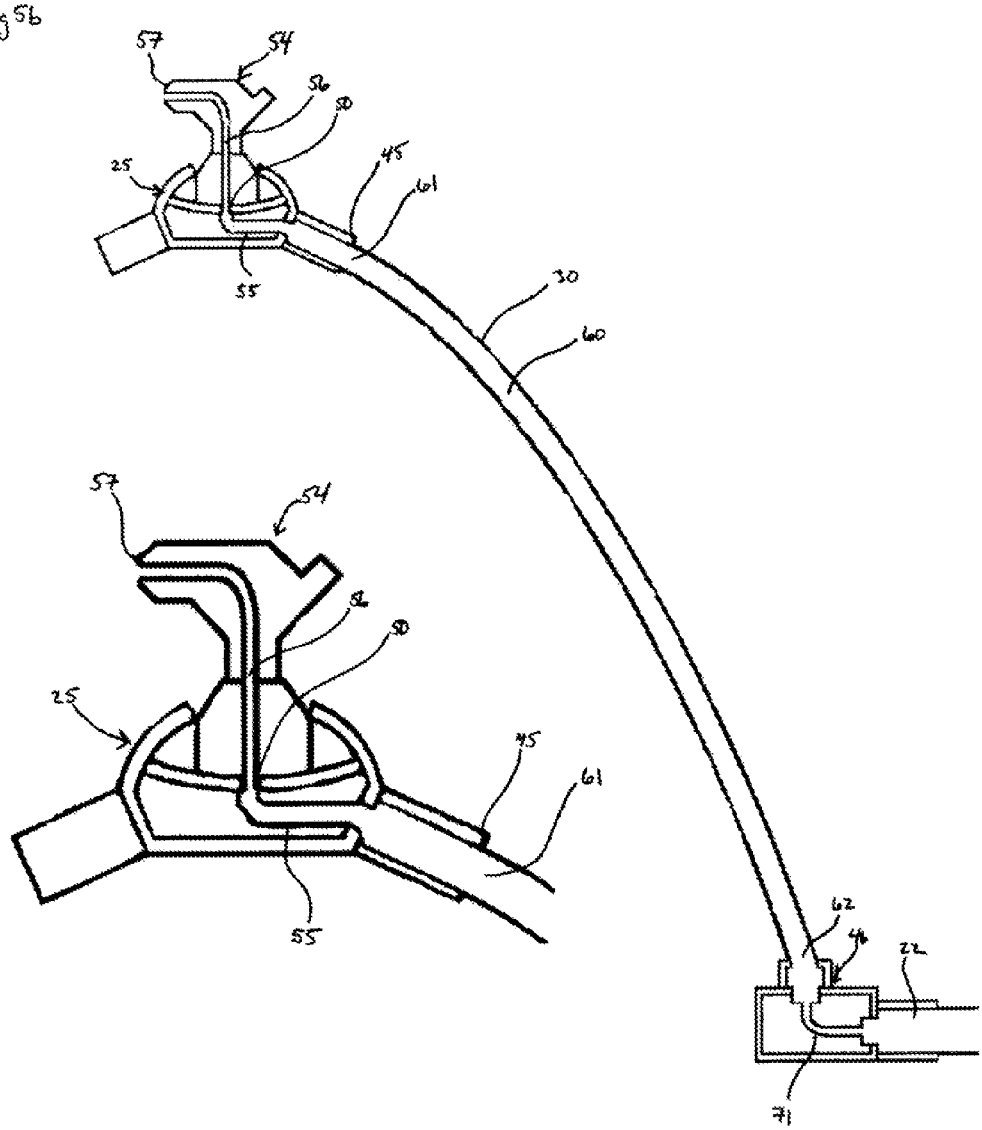
FIG. 5*b* is a side cutaway view of FIG. 5*a* where a motorized sprinkler head is positioned on the top of the tent structure in accordance with an embodiment of the present invention.

Now referring to FIG. 5*b*, a motorized sprinkler head 54 is positioned on the top of the tent structure to spray water in different directions in accordance to a pre-set pattern and desired timing. The motorized sprinkler head 54 is attached to the sprinkler mechanism 25, is in fluid communication with the spray aperture 50, and includes a sprinkler tube 56 to transfer water from the spray aperture 50 to a sprinkler head aperture 57. The sprinkler mechanism 25 further includes a means to activate the motorized sprinkler head 54, such that the motorized sprinkler head 54 rotates and disburses water in a predetermined pattern.

Figure 5C:
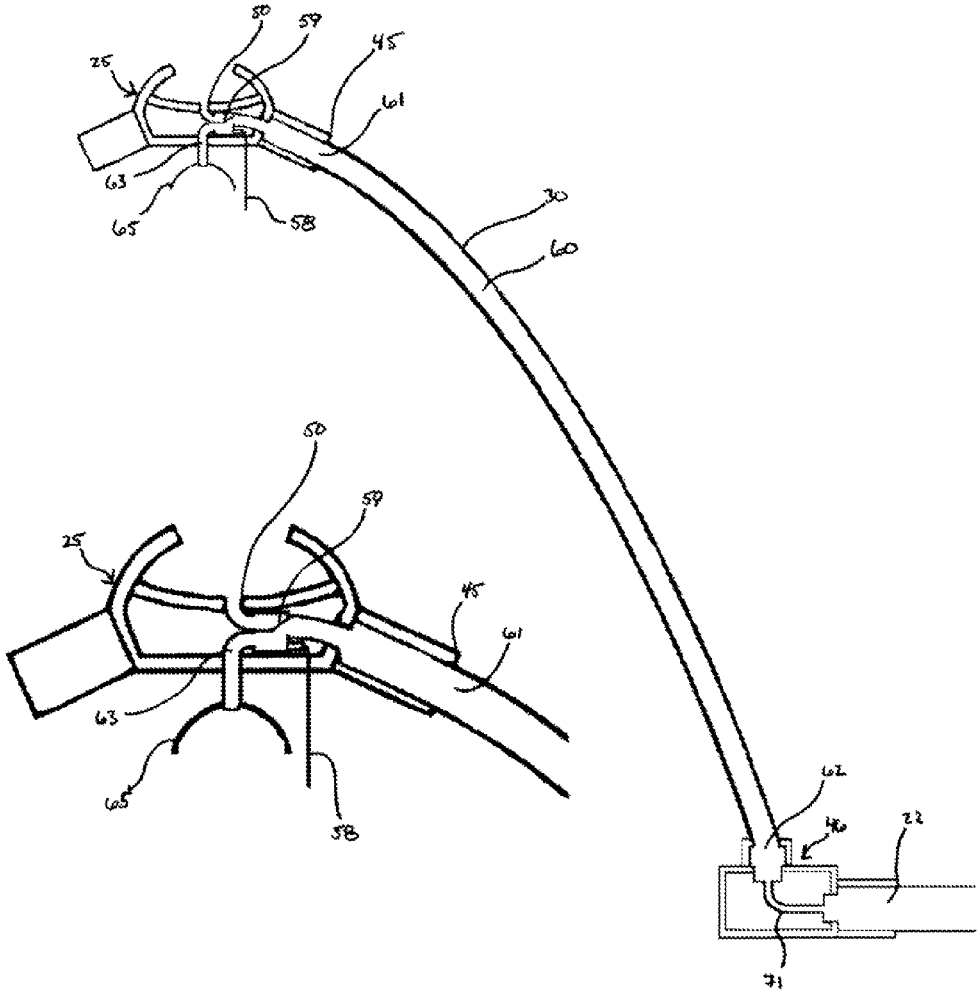
FIG. 5*c* is a side cutaway view of FIG. 5*a* where a shower head is positioned just below the sprinkler mechanism within the tent structure in accordance with an embodiment of the present invention.

Referring now to FIG. 5*c*, a shower head 65 is positioned just below the sprinkler mechanism and in fluid communication with the water transfer system, which when triggered will direct water to flow into the enclosed area 31. A two directional valve 59 is positioned in the flow of water to divert water to the shower head 65. Pulling a triggering cord 58 diverts the water flow to an outlet port 63 on the two directional valve 59 in fluid communication with the shower head 65, such that water is disbursed through the shower head 65 and into the enclosed area 31.

The invention includes a means to transfer water from a garden hose to a sprinkler mechanism positioned at the top of a tent structure.

Figure 6:
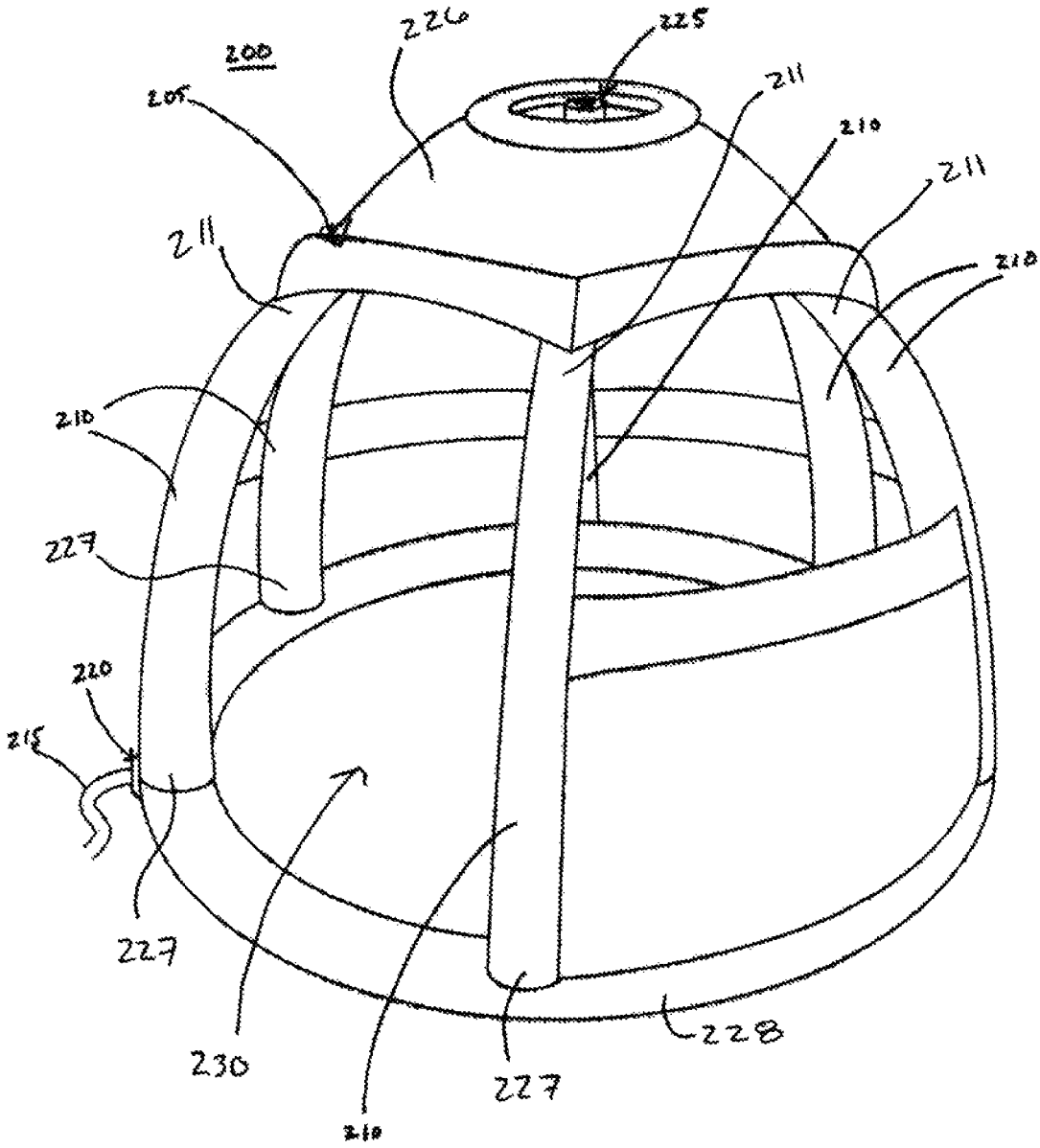
FIG. 6 is a front perspective view of an inflatable tent structure in accordance with an embodiment of the present invention.

Referring now to FIG. 6, in accordance to another embodiment of the present invention, an inflatable tent structure 200 is shown. In this embodiment, the frame includes inflatable segments 210 joined together by a flexible plastic (or similar material) outer membrane 205 where at least one of the inflatable segments 210 includes an internal tube to direct water from a garden hose 215 and base connector 220 to a sprinkler mechanism 225 positioned on the top of the tent structure 200. An upper portion 211 of each inflatable segment 210 is fixed to the sprinkler mechanism 225 via an upper portion 226 of the outer membrane 205. A base portion 227 of each of the inflatable segments 210 is fixed to an inflatable base segment 228 where the outer membrane 205 joins the inflatable segments 210 and the inflatable base segment 228 such that the outer membrane 205 prevents an enclosed area 230 within the tent structure 200 from receiving water.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

I claim:

1. An outdoor water tent device comprising:

a tent structure defined to include a plurality of supports, the plurality supports securing an outer membrane thereto to define an enclosed area under the outer membrane and within the plurality of supports;

a sprinkler mechanism positioned at the top of the tent structure, the sprinkler mechanism having a means for spraying liquid upwardly on top of a side of the outer membrane external to the enclosed area;

means for coupling the sprinkler mechanism to a pressurized source of liquid, whereby, the liquid sprayed from the sprinkler mechanism is directed upwardly such that the liquid tends to rain down on the top of the canopy maintaining the enclosed area substantially dry;

a shower head with a triggering cord positioned within the tent structure; and a two directional valve positioned in the flow of water to divert water to the shower head, wherein, pulling the triggering cord diverts the water flow from the sprinkler mechanism to an outlet port on the two directional valve in fluid communication with the shower head, such that water is disbursed through the shower head and into the enclosed area.

2. The outdoor water tent device of claim 1, wherein the means for coupling the sprinkler mechanism to a pressurized source of liquid further includes:

an inner channel running through one of the plurality of supports, the inner channel having an upper end connected to an intake opening on the sprinkler mechanism, and having a lower end and a base hose connector to securely attach the pressurized source of liquid to the lower end of the inner channel defined by said one of the plurality of supports.

3. The outdoor water tent device of claim 2, wherein, the sprinkler mechanism further comprises an upper tube, a spray aperture, a receiving port sized to receive an upper portion of the support such that the upper tube is in fluid communication with the inner channel at one end and in fluid communication with the spray aperture at the other end.

4. The outdoor water tent device of claim 3, wherein:

the plurality of supports are inflatable segments, an upper portion of each of the inflatable segments fixed to the sprinkler mechanism positioned at the top of the structure via an upper portion of the outer membrane;

a base portion of each of the plurality of supports fixed to an inflatable base segment; and the outer membrane joining the inflatable segments and the inflatable base segment, such that the outer membrane prevents the enclosed area within the tent structure from receiving water.

5. The outdoor water tent device of claim 3, wherein the sprinkler mechanism further comprises:

a motorized sprinkler head attached to the sprinkler mechanism and in fluid communication with the spray aperture;

the motorized sprinkler head including a sprinkler tube to transfer water from the spray aperture to a sprinkler head aperture; and a means to activate the motorized sprinkler head, such that the motorized sprinkler head rotates and disburses water in a predetermined pattern.

* * * * *